US007138957B1

(12) United States Patent
Bruchie

(10) Patent No.: US 7,138,957 B1
(45) Date of Patent: Nov. 21, 2006

(54) DISH ANTENNA KIT INCLUDING ALIGNMENT TOOL AND METHOD OF USE THEREOF

(75) Inventor: Chris E. Bruchie, Mt. Airy, MD (US)

(73) Assignee: Lyman Brothers, Inc., Laurel, MD (US)

( * ) Notice: Subject to any disclaimer, the term of this patent is extended or adjusted under 35 U.S.C. 154(b) by 0 days.

(21) Appl. No.: 11/143,327

(22) Filed: Jun. 2, 2005

Related U.S. Application Data

(62) Division of application No. 10/638,930, filed on Aug. 11, 2003, now Pat. No. 7,050,015.

(51) Int. Cl.
*H01Q 19/19* (2006.01)

(52) U.S. Cl. ..... 343/840; 343/725

(58) Field of Classification Search ..... 343/757, 343/765, 880, 882, 753, 840, 912, 914, 725
See application file for complete search history.

(56) References Cited

U.S. PATENT DOCUMENTS 4,590,481 A 5/1986 Burditt ..... 343/840
4,608,573 A 8/1986 Paullin ..... 343/894
6,002,374 A * 12/1999 Nicholas ..... 343/725
6,462,718 B1 * 10/2002 Ehrenberg et al. ..... 343/880
6,466,175 B1 10/2002 Ehrenberg et al. ..... 343/761
6,806,841 B1 * 10/2004 Nilsson et al. ..... 343/773
7,068,232 B1 * 6/2006 Duncan et al. ..... 343/715

* cited by examiner

*Primary Examiner*—Hoang V. Nguyen
*Assistant Examiner*—Jimmy Vu
(74) *Attorney, Agent, or Firm*—Armstrong, Kratz, Quintos, Hanson & Brooks, LLP

(57) ABSTRACT

A dish antenna kit has at least one reflector, one feed horn, and an alignment tool. The alignment tool has a light source and a base. The base has at least one inner cylindrical surface having a diameter slightly exceeding the outer diameter of a rim of the feed horn. The alignment tool base positions the light source axis with respect to the feed horn axis. A method of aligning the feed horn with respect to the reflector includes: placing the alignment tool on the feed horn; activating the light source; rotating the alignment tool so that a light beam advances in an arcuate path on the surface of the reflector; determining from the arcuate path the offset of the feed horn with respect to a focus point on the reflector surface; and, if the offset is not within the predetermined tolerance, adjusting the feed horn attitude.

10 Claims, 12 Drawing Sheets

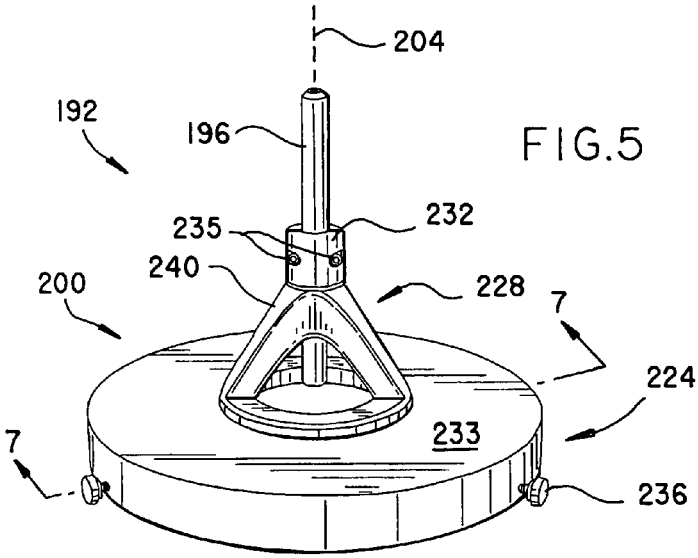
FIG.5
FIG.6
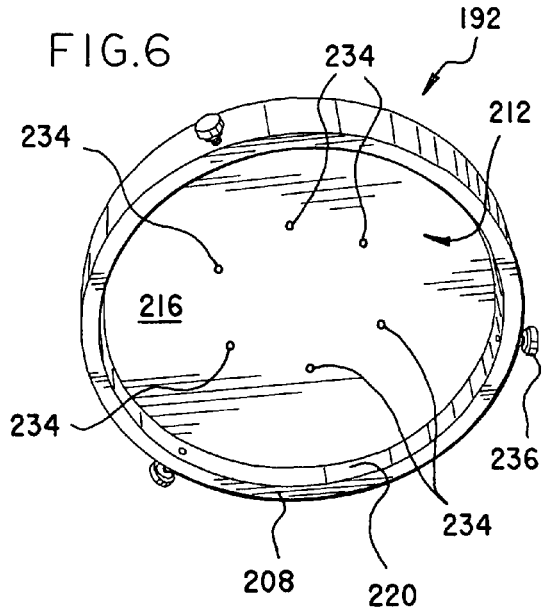
FIG.7
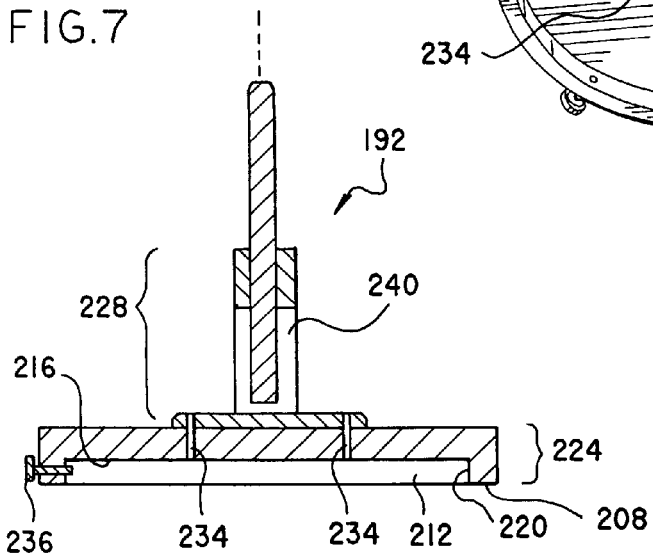

DISH ANTENNA KIT INCLUDING ALIGNMENT TOOL AND METHOD OF USE THEREOF

This application is a divisional application of prior application No. 10/638,930 filed on Aug. 11, 2003 now U.S. Pat. No. 7,050,015.

BACKGROUND

An antenna arrangement presently employed in communication technology includes a feed horn and one or mor associated reflectors. The term "feed horn," as used herein, denotes an antenna capable of transmitting and/or receiving electromagnetic signals, for example, radio or microwave signals. The associated reflector(s) has a surface(s) typically described by rotating a conic sction, for example, a parabola, one full revolution to produce a dish-like surface.

FIG. 1 illustrates an antenna arrangement 100 in which a feed horn 104 is held in front of a reflector 108 by a plurality of spars 112. Feed horn 104 transmits and receives signals along an axis 116. Signals transmitted by feed horn 104 along axis 116 reflect against the surface 120 of reflector 108 en route to their destination. Signals arriving to antenna arrangement 100 reflect against surface 120 of reflector 108 and proceed along axis 116 to feed horn 104. In some usages, an antenna arrangement may be configured so that the feed horn only transmits or only receives signals.

FIG. 2 illustrates an alternate antenna arrangement 124 with two reflectors; a main reflector 128 and a sub-reflector 132. Signals transmitted by a feed horn 136 reflect first against a surface 140 or sub-reflector 132 and then against a surface 144 or main reflector 128 en route to their destination. Signals arriving to antenna arrangement 124 reflect first against surface 124 of main reflector 123 and then against surface 140 of sub-reflector 132 to feed horn 136.

Antenna arrangements 100 and 124 each individually forms "kits," herein referred to as "dish antenna kits." A dish antenna kit may include additional elements. For example, a dish antenna kit may have two feed horns: one feed horn for C-band operation (5.8 to 6.5 GHz.), and one feed horn for Ku-band operation (14 to 14.5 GHz.). The particular feed horn used depends on the needs of the user.

In some dish antenna kits, a relatively large reflector (or main reflector) may be formed as an assembly of a plurality of constituent panels. FIG. 3 illustrates a reflector 148 comprising four panels 152 joined at the edges to form seams 156. (Note that, although four panels are shown in this example, reflectors can have a different number of constituent panels.) Such a configuration permits convenient disassembly of the reflector and subsequent re-assembly of the reflector in the field. Sometimes, the term "fly-away kit" is used in reference to such a kit, due to the ease of disassembly and packaging as airline baggage to accompany the deployment personnel to a remote location to assemble the disk antenna kit.

Another type of dish antenna kit 160 adapted for mobility incorporates a trailer. As illustrated in FIG. 4, an antenna arrangement 162 including a feed horn 164 and a reflector 168 are mounted on a trailer 172. Also in this arrangement, a router 176 is housed inside an air-conditioned enclosure 180. Both the router 176 and the air conditioner of air-conditioned enclosure 180 are powered by a generator 184. To protect the router 176 from the vibrations caused by generator 184, shock attenuators 188 may be mounted between trailer 172 and enclosure 180. Accordingly, the dish antenna kit 160 may be conveniently towed to a remote location for use.

Whether in the field, the manufacturing facility, or elsewhere, the feed horn must be properly aligned with respect to the reflector(s) to optimize gain. The feed horn axis 116 (FIG. 1) desirably intersects with the reflector surface as close as possible to the surface's focus point. (The "focus point" is the point on the surface of the reflector for which the antenna gain is maximized if the feed horn axis intersects therewith.) The focus point of a reflector is often the center of the reflector's surface, although off-center focus points are sometimes desired.

Antenna arrangements in the field may also occasionally require realignment of the feed horns relative to the reflectors. Severe weather conditions or intrusive wildlife, such as spider monkeys, can misalign the antenna arrangements. Also, vibrations from generators, if part of the dish antenna kits, may require periodic realignment of the feed horns relative to the reflectors.

With limited success, various alignment tools have been proposed to facilitate the alignment procedure. For example, Burditt (U.S. Pat. No. 4,590,481) and Paullin (U.S. Pat. No. 4,608,573) disclose alignment tools that attach to a feed horn. "Telescoping" rods are extended to the reflector surface to indicate whether the feed horn axis intersects with the reflector surface at or near the focus point. These alignment tools require high precision manufacturing to ensure that the extended rods properly indicate where the feed horn axis intersects with the reflector surface.

Ehrenberg et al. (U.S. Pat. No. 6,466,175) discloses a dish antenna kit, and its FIGS. 24 and 25, with the corresponding text in the specification, illustrate a light source, sized and shaped for mounting in an antenna arrangement in place of the feed horn. A light beam projects upon the reflector surface to indicate whether the feed horn axis, after the feed horn later replaces the light source, will intersect with the reflector surface at the focus point. Such light source requires high precision manufacturing to ensure that its beam projects collinearly with the later position of the feed horn axis after the feed horn replaces the light source.

Ehrenberg et al. also provides a cursory statement (col. 18, lines 55–58) that a light source may be fashioned for attachment directly to the feed horn. However, no development of this idea accompanies the Ehrenberg et al. statement, so there is no guidance of how such an alignment tool can be created in such a way that it would not also require such high precision manufacturing in order to effect, correspondingly, high precision alignment.

To the present inventor's knowledge and belief, this aspect of Ehrenberg et al. has not been produced commercially and is not on the market.

Other procedures for aligning a feed horn relative to the reflector of an antenna arrangement are tedious and require multiple personnel using a variety of tools or implements (for example, tape measures, and mechanical gap gauges). An example of such a procedure is described in the Andrew installation guide. After following such procedures, uncertainty in proper alignment often remains due to the lack of a simple way to verify alignment.

Despite widespread use of lasers for alignment purposes (for example, installing dropped ceilings) no one, prior to the present inventor, has successfully adapted laser-alignment devices to the to the peculiar problems encountered in feed horn alignment for satellite antennas on the commercial market.

Accordingly, to the best knowledge of the present inventor, there remains a need for a dish antenna kit that includes an alignment tool, which is both easy to use and achieves highly precise alignment of the feed horn with respect to the reflector of the kit. Also, it is desirable that such an alignment tool provide the highly precise alignment without requiring manufacturing of as high precision and cost as that for the prior art discussed above.

SUMMARY OF THE INVENTION

A primary object of the present invention is to alleviate the aforementioned deficiencies and disadvantages of the prior art by providing a dish antenna kit, including a specially-developed alignment tool, and an associated method that satisfy the above-described needs.

It is another object of the present invention to provide an alignment apparatus and method which is quick, convenient and easy to use, does not require highly-trained personnel, and may be used out in the field in remote areas, often in difficult terrain, and sometimes under hostile conditions.

It is yet another object of the present invention to provide such an alignment system which is ideally suited for use with the relatively high-volume and conversely, the relatively-inexpensive "low-end" satellite antenna systems presently in widespread use throughout the world.

It is a further object of the present invention to provide an apparatus and method for quickly re-aligning existing satellite antenna systems.

One exemplification of the present invention is a dish antenna kit that has a reflector sub-assembly, at least one feed horn, and an alignment tool. The reflector sub-assembly has at least a first reflector and may also have a second reflector. The feed horns of the kit each have a feed horn axis and, positioned at one axial end of the feed horn, a rim having an outer diameter. The alignment tool has a light source and a base. The dish antenna kit of the present invention may also include a power source, signal processing equipment, and/or a trailer.

With particular reference to the alignment tool, its light source has a light source axis and is configured to direct a beam of light along the light source axis. The base has a bottom surface, an inner planar surface, and an inner cylindrical surface extending between the bottom surface and the inner planar surface. The inner cylindrical surface has a diameter slightly exceeding the outer diameter of an associated feed horn rim. The alignment tool base may be configured with additional inner planar and cylindrical surfaces so that the alignment tool can fit different size feed horns. The base is further configured to position said light source axis with respect to the feed horn axis when an inner cylindrical surface is positioned around a feed horn rim and an inner planar surface abuts the feed horn rim. Expressing an aspect of the invention in an alternative fashion, the base is configured to position the light source axis with respect to an inner planar surface.

Another exemplification of the present invention is a method of aligning a feed horn with respect to a reflector of a dish antenna kit. The inventive method includes: placing an alignment tool on the feed horn; activating a light source of the alignment tool to project a beam of light onto a surface of the reflector; rotating the alignment tool so that the light beam advances in an arcuate path on the reflector surface; determining from the arcuate path the offset of the feed horn with respect to a focus point on the reflector surface; checking whether the offset is within a predetermined tolerance; and, if the offset is not within the predetermined tolerance, adjusting the attitude of the feed horn to decrease the offset.

One way of determining the offset of the feed horn with respect to a focus point is by detecting the center of the arcuate path and then detecting the distance of the center from the focus point. This distance represents the offset.

Another way of determining the offset of the feed horn with respect to a focus point may be practiced when the reflector includes a plurality of constituent panels joined at the edges to form seams, and when the focus point of the reflector is its center where the seams meet. The offset may be determined by detecting a plurality of intersections of the arcuate path with a plurality of the scams and then detecting the relative distances of the intersections from the reflector center.

The present invention is described in detail below with reference to the accompanying drawings, which are summarized as follows:

BRIEF DESCRIPTION OF THE DRAWINGS

FIG. 5 is a perspective view of an alignment tool in accordance with one embodiment of the present invention;

FIG. 6 is a bottom perspective view of the alignment tool of FIG. 5;

FIG. 7 is a cross-sectional view of the alignment tool of FIGS. 5 and 6, taken along the lines 7—7 of FIG. 5;

DETAILED DESCRIPTION OF THE INVENTION

Figure 1:
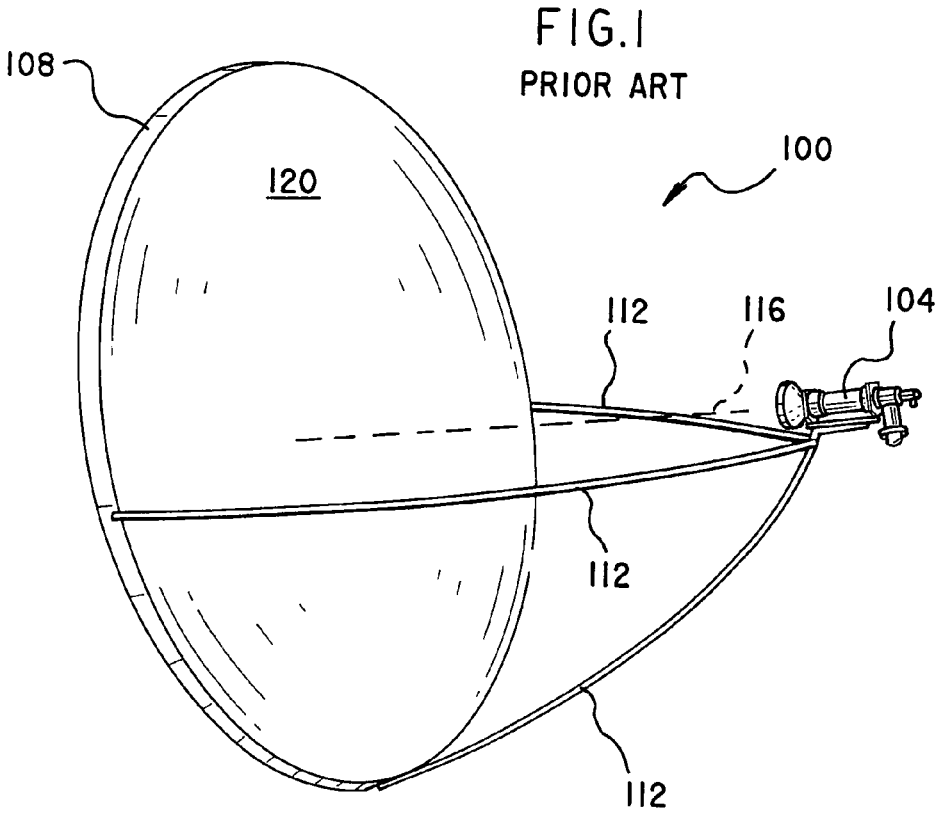
FIG.1 PRIOR ART
FIG. 1 features a prior art antenna arrangement that includes a feed horn and an associated reflector.
Figure 2:
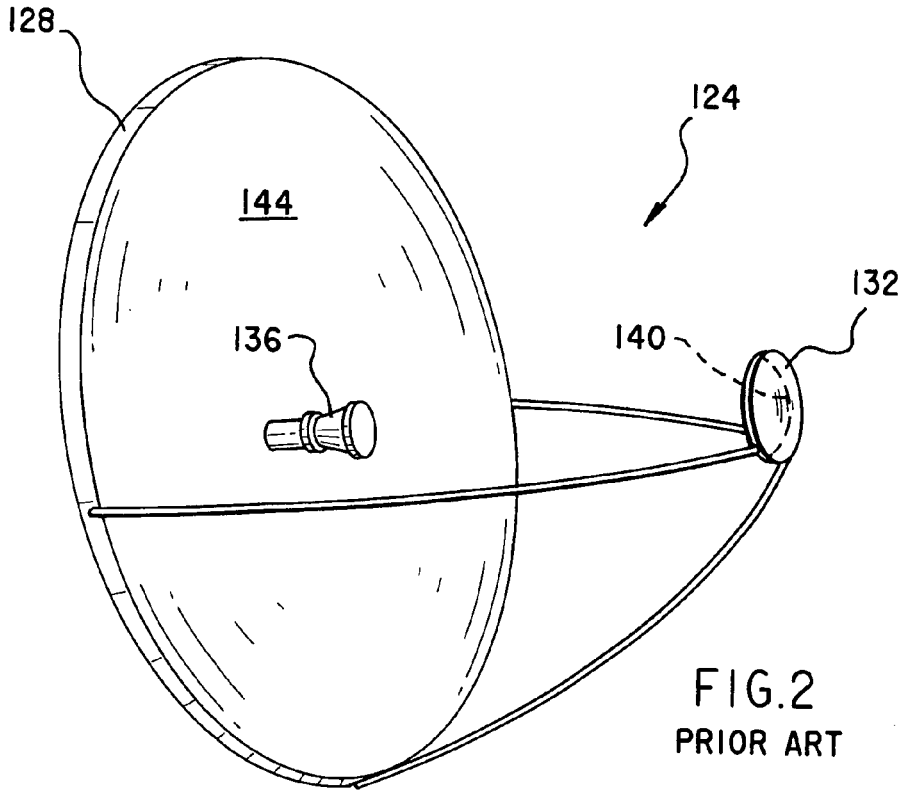
FIG.2 PRIOR ART
FIG. 2 features an alternate prior art antenna arrangement that includes a feed horn, an associated main reflector, and an associated sub-reflector.
Figure 3:
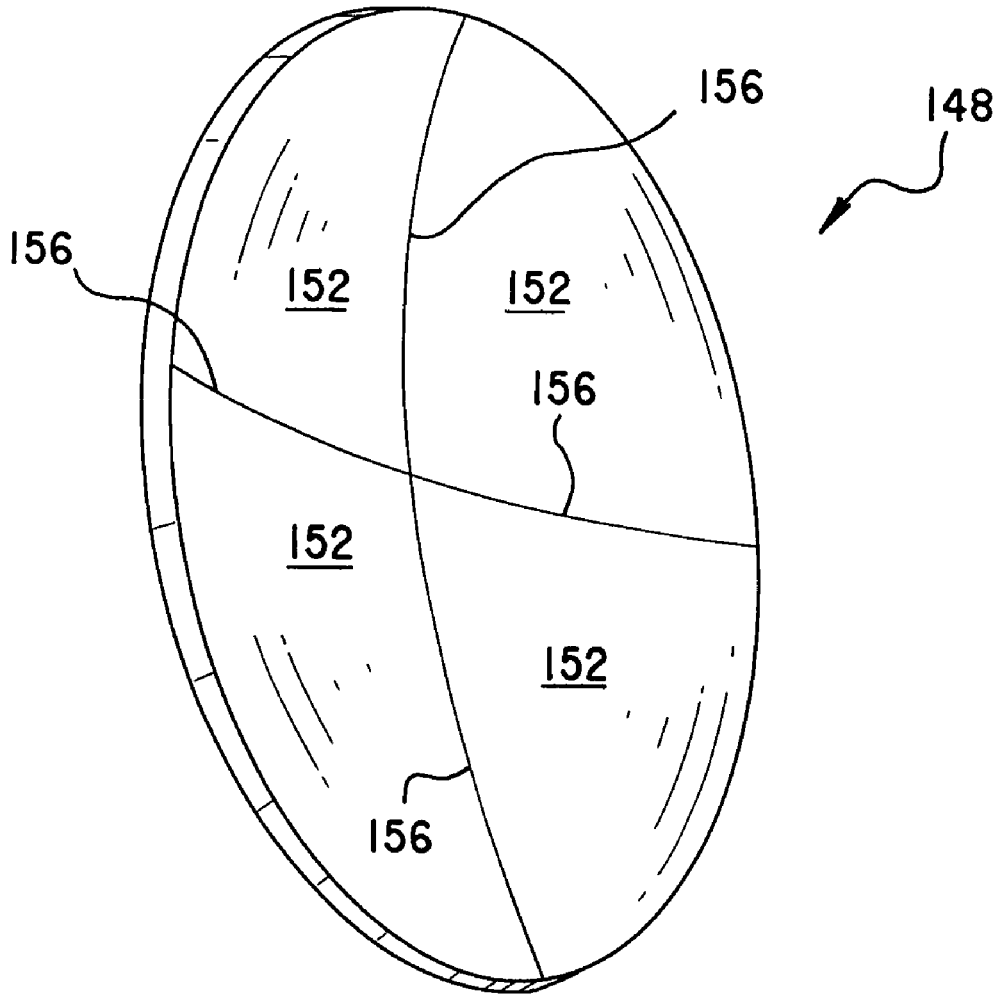
FIG.3 PRIOR ART
FIG. 3 illustrates a prior art reflector formed as an assembly of constituent panels.
Figure 4:
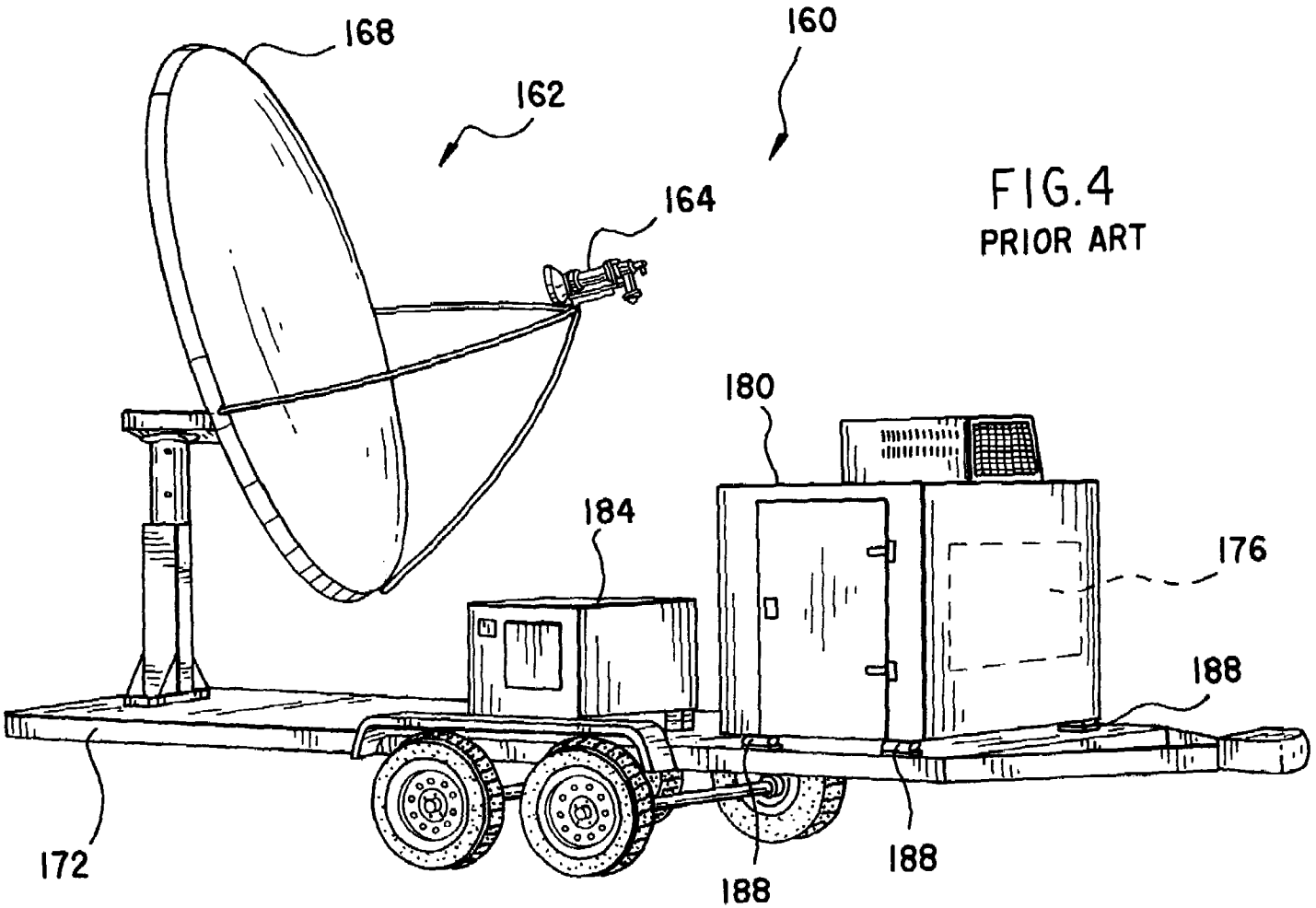
FIG. 4 PRIOR ART
FIG. 4 illustrates a prior art dish antenna kit.

The invention summarized above and defined by the claims below may be better understood by referring to the present detailed description, which should be read with reference to the accompanying drawings. This detailed description presents preferred embodiments of the present invention. This description is not intended to limit the scope of the claims but instead to provide examples of the invention.

Described first are preferred embodiments of alignment tools configured in accordance with the present invention. Next described is an exemplary-preferred embodiment of a dish antenna kit, which includes an alignment tool, such as an alignment tool configured in accordance with the preferred embodiments disclosed herein. Lastly, disclosed is a method of aligning a feed horn with respect to a reflector of a dish antenna kit. The dish antenna kit may be a dish antenna kit according to the embodiment disclosed herein, and the dish antenna kit may include an alignment tool configured in accordance with the preferred embodiments of alignment tools disclosed herein.

The alignment tool of the present invention facilitates the proper alignment of a feed horn with respect to an associated reflector of a dish antenna kit. One preferred embodiment of the alignment tool of the dish antenna kit is described with reference to FIGS. 5–7. FIG. 5 is a perspective view, FIG. 6 is a bottom view, and FIG. 7 is a cross-sectional view.

In this embodiment, an alignment tool 192 has a light source 196 and a base 200. Light source 196 has a light source axis 204, and light source 196 is configured to direct a beam of light along light source axis 204. In this embodiment, light source 196 is a laser light source, although other light sources may also be used. Base 200 has a bottom surface 208 with a recess 212. Within recess 212, base 200 has an inner planar surface 216 and an inner cylindrical surface 220, which extends between bottom surface 208 and inner planar surface 216.

In the present invention, light source 196 is secured against base 200 to position light source axis 204 with respect to inner planar surface 216. In the embodiment of FIGS. 5–7, alignment tool 192 is illustrated as having light source 196 positioned relative to base 200 so that light source axis 204 is substantially perpendicular to inner planar surface 216. However, in accordance with the present invention, light source axis 204 need not be precisely aligned exactly perpendicular to inner planar surface 216. Using the method of the present invention, highly precise alignment of a feed horn with respect to the associated reflector of a kit may be achieved without requiring highly precise and costly manufacturing procedures to insure that light source axis 204 is virtually-exactly perpendicular to inner planar surface 216.

In this embodiment, alignment tool base 200 is formed as a combination of a first portion 224, a second portion 228, and third portion 232. As is apparent from the FIGS. 5–7, the surface of first portion 224 includes bottom surface 208, inner cylindrical surface 220, and inner planar surface 216. Second portion 228 attaches to first portion 224 on a side 233, which is opposite recess 212. In this embodiment, first portion 224 and second portion 228 are mutually attached using counter-sunk machine screws 234. Third portion 232 secures light source 196 against second portion 228 so that light source axis 204 is positioned with respect to inner planar surface 216. Again, for reasons provided below, it is not necessary that light source axis 204 be positioned exactly perpendicular to inner planar surface 216. In this embodiment, bolts or screws 235 bias third portion 232 toward second portion 228 to secure light source 196 therebetween.

Base 200 includes fasteners 236, which are configured to extend diametrically through first portion 224 toward inner cylindrical surface 220. A non-limiting example of a "fastener" is a thumbscrew, but other fastening means are within the scope of the invention. As discussed below, fasteners 236 secure alignment tool 192 against a feed horn to allow a user to perform other alignment functions without the need to constantly hold alignment tool 192 against the feed horn.

In the present embodiment, second portion 228 includes multiple support struts 240 to hold light source 196 with respect to base 200. With such structure, the amount of material required for manufacturing the alignment tool is reduced, and the resulting product is lighter. To reduce weight further, lighter materials may be used for base 200. Example materials for base 200 include machine aluminum, stainless steel, plastic, or composite. As shown in the drawings, second portion 228 is a generally-conical intermediate portion secured to base 200 substantially-centrally thereof. A converging end portion is distal to base 200, and the laser-holding portion is mounted on the converging end portion.

Figure 8:
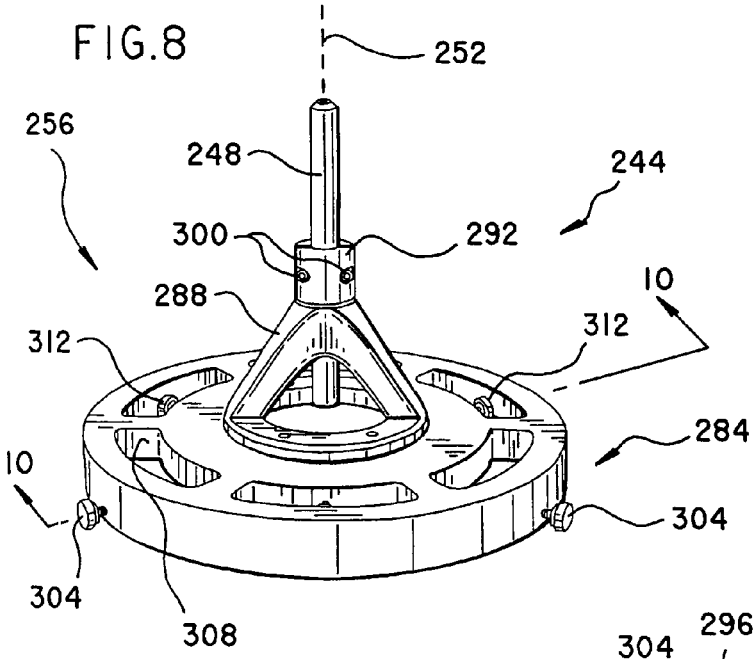
FIG. 8 is a perspective view of an alignment tool in accordance with an alternate embodiment of the present invention.
Figure 9:
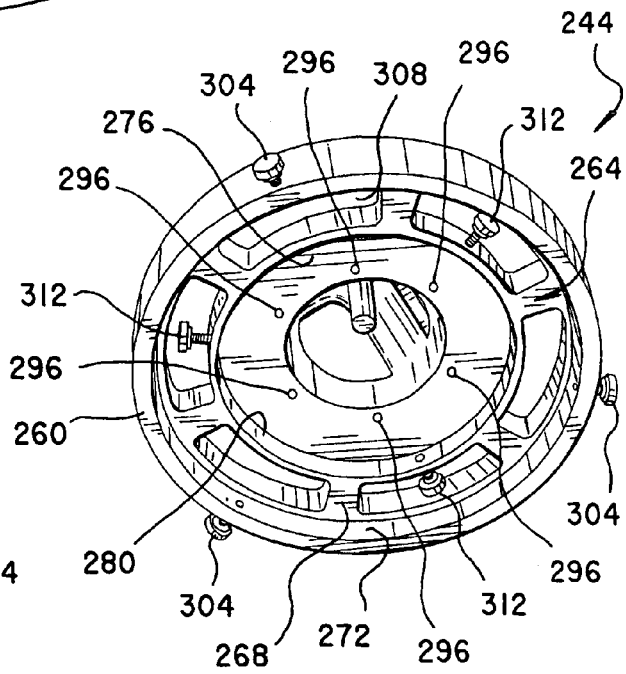
FIG. 9 is a bottom perspective view alignment tool of FIG. 8.
Figure 10:
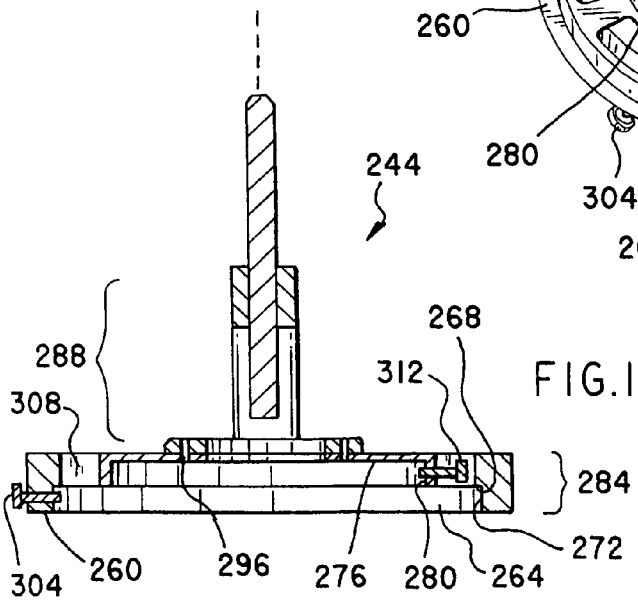
FIG. 10 is a cross-sectional view of the alignment tool of FIGS. 8 and 9, taken along the lines 10—10 of FIG. 8.

Another preferred embodiment of the present invention is illustrated in FIGS. 8–10. FIG. 8 is a perspective view of an alignment tool 244, FIG. 9 is a bottom view, and FIG. 10 is a cross-sectional view. This type of alignment tool may utilize the same type of light source as used in the previously-described embodiment, but the base is modified. As described next, the recess in the underside of the base has two inner cylindrical surfaces and two inner planar surfaces. With this configuration, the alignment tool is particularly useful in a dish antenna kit that has two feed horns that have different-sized feed horn rims. For example, dish antenna kits commonly include both a feed horn for C-band operation and another feed horn for Ku-band operation, the former having a larger rim diameter than the latter.

As in the previous embodiment, alignment tool 244 has a light source 248, with a light source axis 252, and a base 256. Base 256 is configured to position light source axis 252 with respect to said second inner planar surface. Base 256 also has a bottom surface 260 with a recess 264 therein.

In this embodiment, base 256 has within recess 264 a first inner planar surface 268 and a first inner cylindrical surface 272, which extends between bottom surface 260 and first inner planar surface 268. First inner cylindrical surface 272 has a first diameter D1. Base 256 further includes a second inner planar surface 276 and a second inner cylindrical surface 280, which extends between first inner planar surface 268 and second inner planar surface 276. Second inner cylindrical surface 280 has a second diameter D2, which is less than first diameter D1.

The values of diameters D1, D2 may be set accordingly to user needs. As an example, for a dish antenna kit that has both a feed horn for C-band operation and another feed horn for Ku-band operation, first diameter D1 may be set to slightly exceed the diameter of rim of the feed horn for C-band operation, and second diameter D2 would be set to slightly exceed the diameter of the rim of the feed horn for Ku-band operation. Diameters D1, D2 are set to slightly exceed the diameters of the feed horn rims to allow sliding with sufficient ease between inner cylindrical surfaces 272, 280 and the outer surfaces of the feed horn rims. However, diameters D1, D2 are otherwise maintained small enough so that the fit remains snug between inner cylindrical surfaces 272,280 and the outer surfaces of the feed horn rims.

Analogous to the earlier-described embodiment, alignment tool base 256 is formed as a combination of a first portion 284, a second portion 288, and a third portion 292.

As is apparent from FIGS. 8–10, the surface of first portion 284 includes bottom surface 260, first inner cylindrical surface 272, first inner planar surface 268, second inner cylindrical surface 280, and second inner planar surface 276. First portion 284 and second portion 288 are mutually attached using counter-sunk machine screws 296. Third portion 292 secures light source 248 against said second portion 288 so that light source axis 252 is positioned with respect to first and second inner planar surfaces 268,276. In this embodiment, the angle between light source axis 252 and first and second inner planar surfaces 268,276 is substantially perpendicular; however, as stated, the angle need not be virtually-exactly perpendicular. In this embodiment, bolts or screws 300 bias third portion 292 toward second portion 288 to secure light source 248 therebetween.

Base 256 includes fasteners 304, which are configured to extend diametrically through first portion 284 toward first inner cylindrical surface 272. Base 256 also apertures 308 to allow access to fasteners 312, which are configured to extend from apertures 308 toward second inner cylindrical surface 280. A non-limiting example of fasteners 304,312 are thumbscrews, but other fastening means are within the scope of the invention. As with the previously-described embodiment, fasteners 304, 312 secure alignment tool 244 against a feed horn to allow a user to perform other alignment functions without the need to constantly hold alignment tool 244 against the feed horn.

In the first above-described embodiment of the present invention, an alignment tool is disclosed as configured to fit feed horns of one particular rim diameter, and, in the second above-described embodiment, another alignment tool is disclosed as configured to fit feed horns having either of two different rim diameters. From the present disclosure, it will be apparent to those skilled in the art that other embodiments of the present invention include alignment tools that are configured to fit feed horns having one or more than two different rim diameters. Such a configuration may include a series of appropriately-sized inner cylindrical and inner planar surfaces within the alignment tool base.

The following description describes a non-limiting example of dish antenna kit representative of the present invention.

Figure 11:
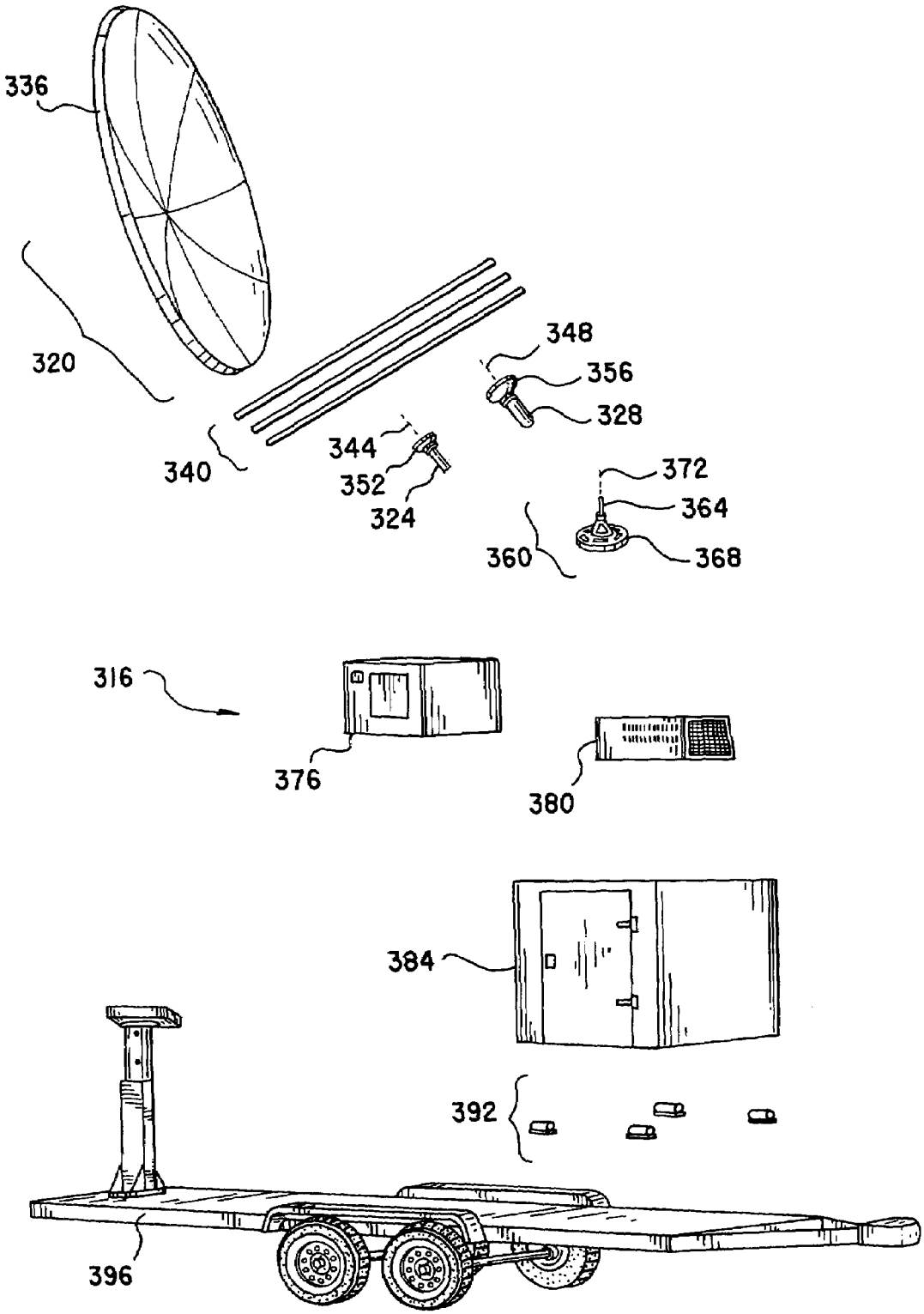
FIG. 11 illustrates an embodiment of a dish antenna kit in accordance with the present invention.

As illustrated in FIG. 11, a dish antenna kit 316 includes a reflector sub-assembly 320, two feed horns 324,328 having different rim diameters, and an alignment tool 332. In reflector sub-assembly 320, only a main reflector 336 is shown, but a reflector sub-assembly including also a sub-reflector is within the scope of the present invention. Also shown in FIG. 11 are spars 340 for mounting either of feed horns 324 or 328 relative to main reflector 336. Each feed horn 324,328 has a feed horn axis 344,348 and a rim 352,356, which is positioned at one axial end of feed horn 324,328. Feed horn rims 352 and 356 have different diameters.

Dish antenna kit 316 also includes an alignment tool 360 having a light source 364 and a base 368. Alignment tool 360 may be configured as described above in reference to two preferred embodiments of the present invention. Here, light source 364 is configured to direct a beam of light along a light source axis 372. Base 368 is configured to position light source axis 372 with respect to feed horn axis 344 and 348 when a base 368 inner cylindrical surface is positioned around a feed horn rim 352 and 356 and a base 368 inner planar surface abuts the feed horn rim 352 and 356.

As further illustrated in FIG. 11, dish antenna kit 316 may also include a power source 376, for example, a diesel generator, signal processing equipment 380, for example, a router, and an air-conditioned enclosure 384 to house signal processing equipment 388. Both signal processing equipment 388 and the air conditioner of air-conditioned enclosure 384 may be powered by power source 376. To protect the signal processing equipment 388 from the vibrations caused by power source 376, enclosure 384 may be mounted on shock attenuators 392. Also shown in FIG. 11 is a trailer 396 for mounting and transporting the aforementioned kit elements.

Although the foregoing example of a dish antenna kit includes many elements, the term "dish antenna kit" is not limited accordingly. For example, a feed horn, a reflector sub-assembly, and an alignment tool are sufficient to constitute a dish antenna kit in the context of the present invention.

Figure 12:
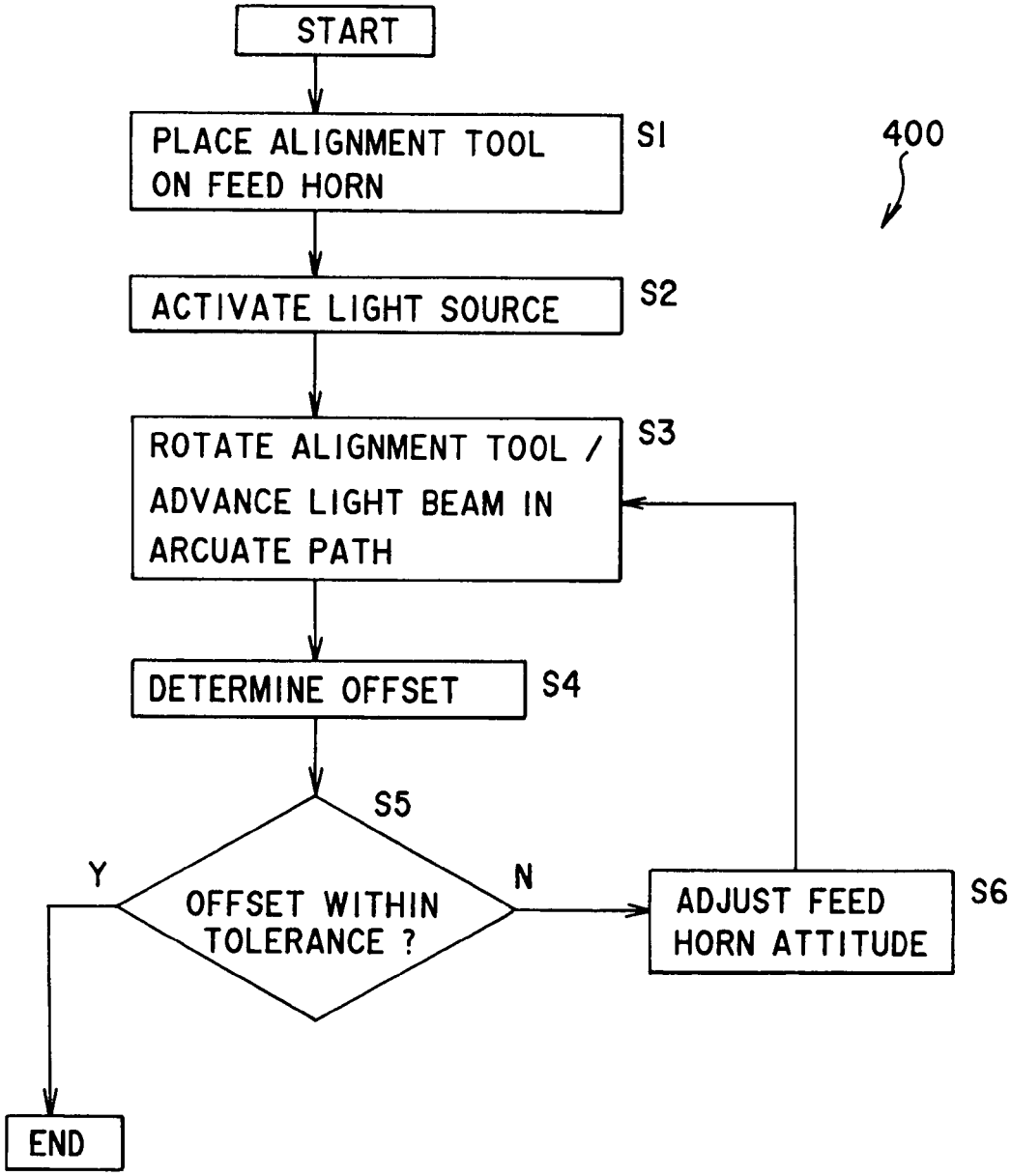
FIG. 12 is a flow chart representing a method of aligning a feed horn with respect to a reflector of a dish antenna kit according to another embodiment of the present invention.

A preferred method of aligning a feed horn with respect to a reflector of a dish antenna kit will now be described with reference to flow chart 400 in FIG. 12.

Figure 13A:
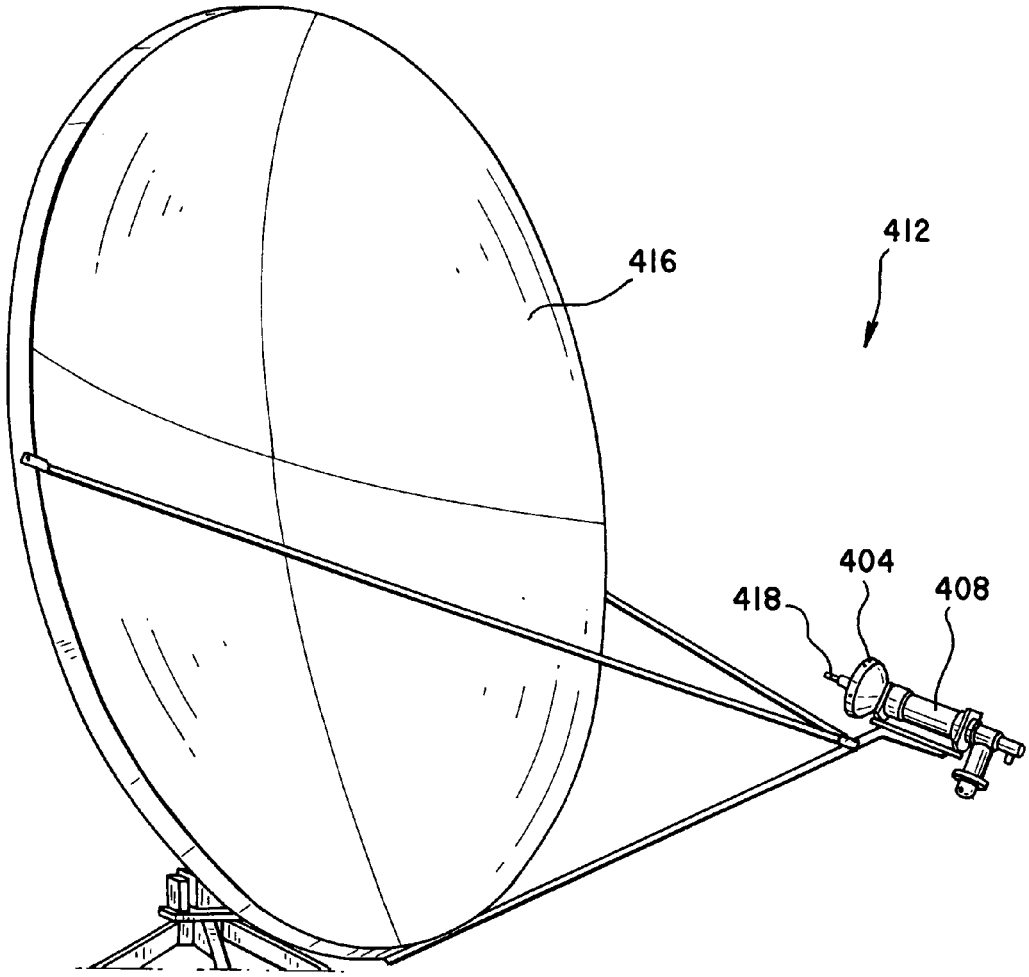
FIG. 13A illustrates an alignment tool in place on a feed horn in accordance with a step of the method represented in FIG. 12.
Figure 13B:
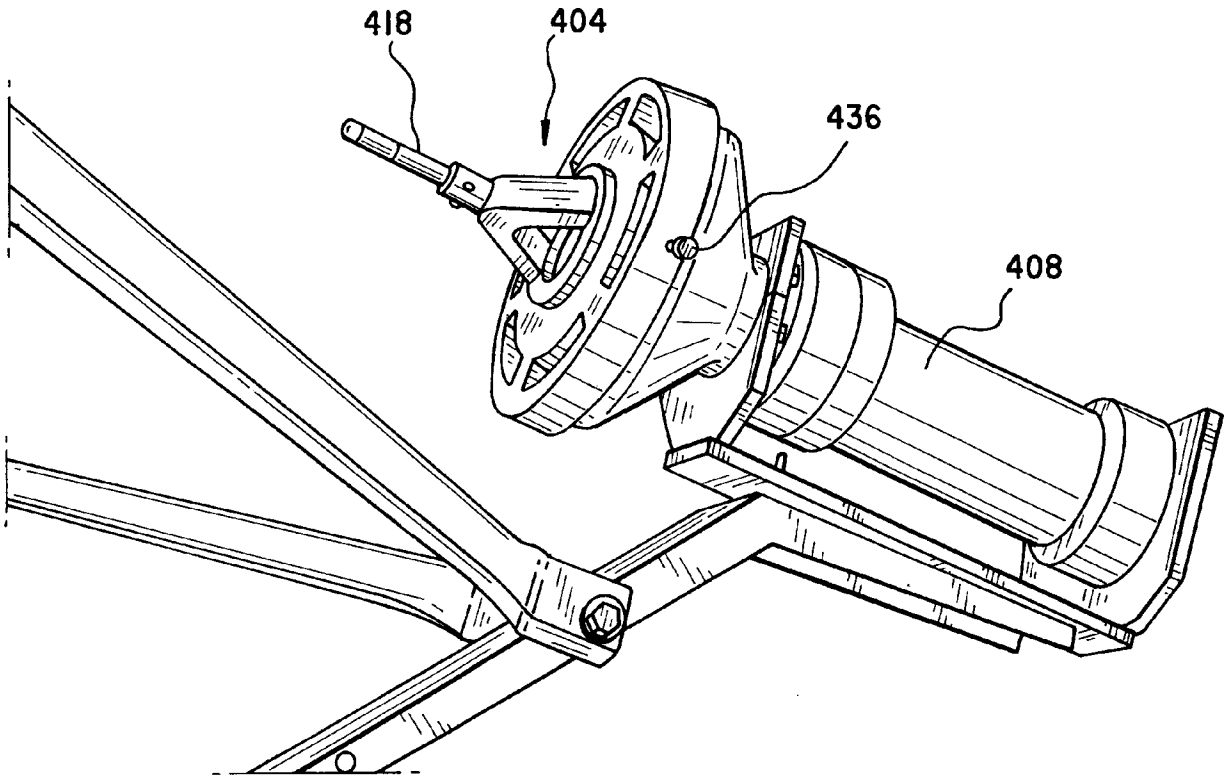
FIG. 13B is a close-up view of FIG. 13A.
Figure 14:
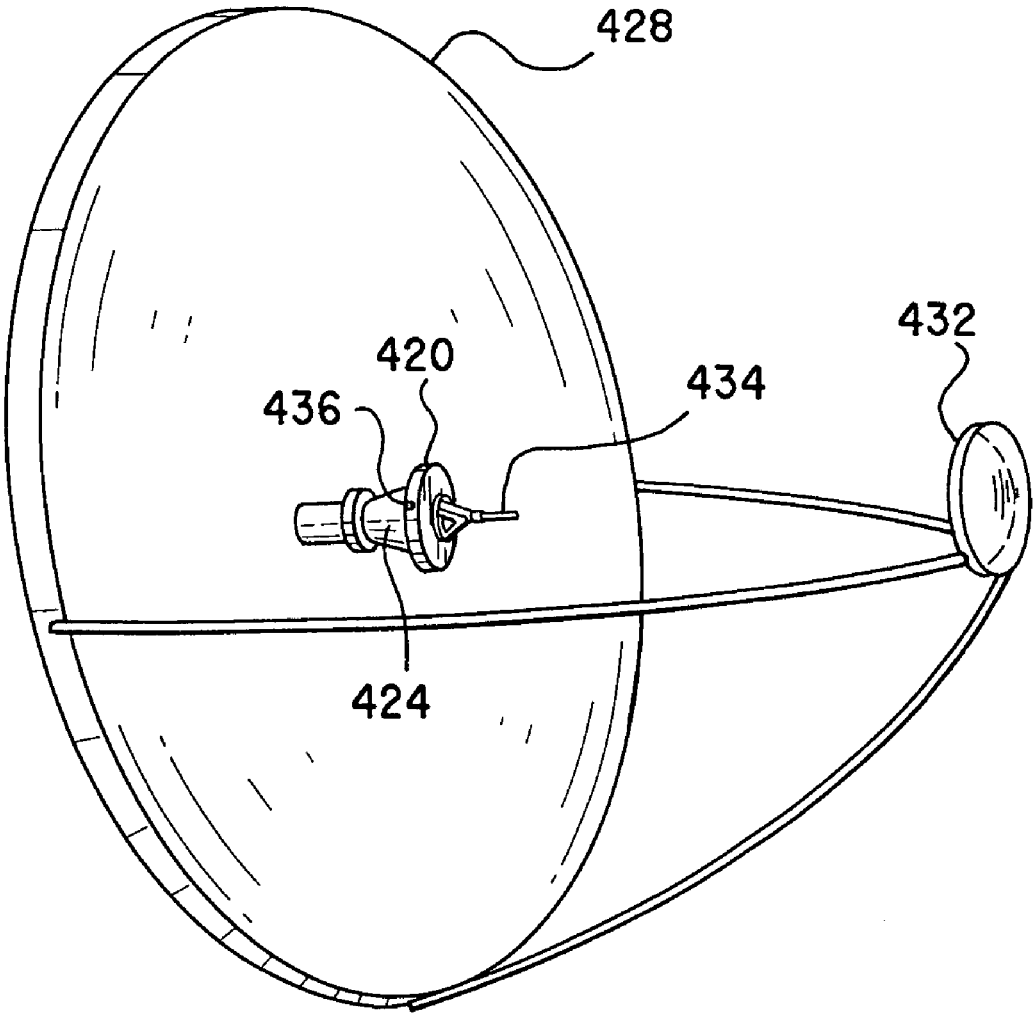
FIG. 14 illustrates a view analogous to that of FIG. 13A for an antenna sub-assembly that includes a main reflector and a sub-reflector.
Figure 15:
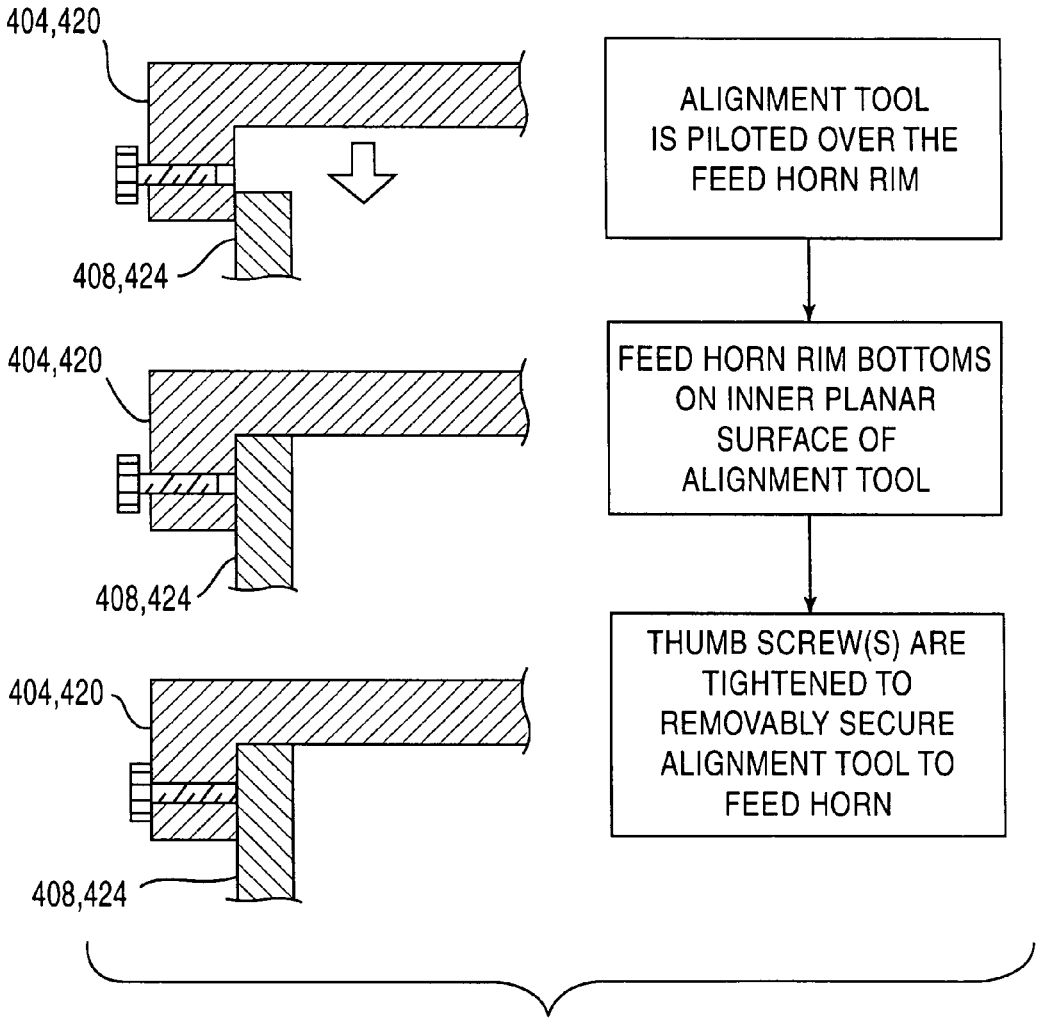
FIG. 15 illustrates an alignment tool being piloted over and removably secured to a feed horn.

Initially, the alignment tool is placed on the feed horn. [Step 1]. FIG. 13A illustrates an example of an alignment tool 404 placed on a feed horn 408 of a dish antenna kit 412 having a single reflector 416. FIG. 13B is a close up view of FIG. 13A. Alignment tool 404 positions a light source 418 to direct a light beam toward reflector 416. FIG. 14 shows another example of an alignment tool 420 placed on a feed horn 424, wherein the antenna sub-assembly has a main reflector 428 and a sub-reflector 432. Here, the alignment tool 420 positions a light source 434 to direct a light beam toward sub-reflector 432. In both examples, fasteners 436 may be used to engage feed horn 408,424 to secure the alignment tool 404,420 thereto, thus relieving the user of the need to manually hold the alignment tool 404,420 in place. FIG. 15 illustrates alignment tool 404, 420 being piloted over and removably secured to feed horn 408, 424.

At this time, the light source is activated (if not activated already). [Step S2.] The light source now projects a beam of light onto the surface of the reflector.

The user now rotates the alignment tool about the light source axis [Step S3.] The fasteners of the alignment tool would need to be disengaged with the feed horn rim. A typical amount of rotation would be 360 degrees. However, for reasons that will be apparent below, a full 360 degrees is unnecessary.

As the alignment tool rotates, the light beam most likely moves across the reflector surface in an arcuate path. If the alignment tool is rotated 360 degrees, the arcuate path will be a circle. The light beam advances in an arcuate path because of difficulties in orienting the light source axis exactly perpendicular to the inner planar surfaces of the alignment tool base. When the alignment tool is manufactured with such high precision to insure that the light source axis is extremely close to perpendicular to the inner planar surfaces of the base, the arcuate path of the light beam is replaced with a single point of light, and rotation of the alignment tool is otherwise unnecessary. However, using the technology of the present invention, a non-perpendicular relationship may be tolerated without sacrificing precision in feed horn alignment.

Figure 16:
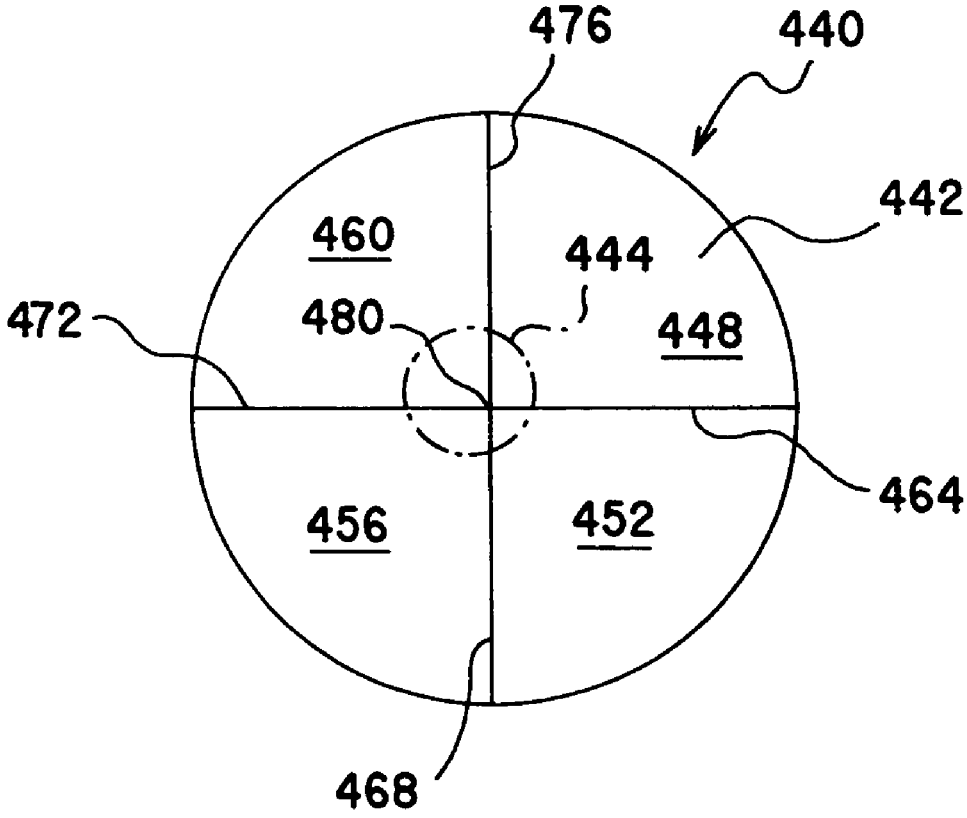
FIG. 16 illustrates a reflector of an antenna sub-assembly with a light beam arcuate path projected on the reflector surface in accordance with another step of the method represented in FIG. 12.

A reflector 440 is illustrated in FIG. 16 with a light beam arcuate path 444 on its surface 442. In this example, arcuate path 444 is a complete circle. Also, in this example, the reflector 440 is formed from four constitute panels 448,452, 456,460 joined at seams 464,468,472,476. For purposes of this example, the focus point 480 of the reflector is located at the center of the reflector 440.

The next step is to determine, from the arcuate path, the offset of the feed horn with respect to focus point 480 on reflector surface 442. [Step 4.] Although the inventor does not represent that the drawings herein are to scale, it shall be apparent from FIG. 16 that the center of arcuate path 444 is not coincident with focus point 480 of reflector surface 442, thus indicative of feed horn misalignment.

One way to determine, from arcuate path 444, the offset of the feed horn with respect to focus point 480 of the reflector surface 442 includes the following two steps: First, the center of arcuate path 444 is detected. Then, the distance from the center of arcuate path 444 to focus point 480 is detected. This distance indicates the magnitude of the offset. The direction of the offset will be apparent from observation of the location of the center of arcuate path 444 relative to focus point 480.

Another way to determine, from arcuate path 444, the offset of the feed horn with respect to focus point 480 is to detect the intersection of arcuate path 444 with each of seams 464,468,472,476. The relative distances of each of the intersections from focus point 480 indicates the magnitude and direction of the offset.

It should be noted that, although the latter way to determine offset requires that the reflector of the dish antenna kit include a plurality of constituent panels joined at the edges to form seams, the former way to determine offset does not require that the reflector have such seams. Also, when the alignment tool is manufactured such high precision that, upon rotation of the alignment tool, a single point of light instead of an arcuate path appears on the reflector surface, the magnitude and direction of the offset is determined analogously to the former way described above for determining the magnitude and direction of the center of an arcuate path relative to a focus point.

The next step is to check if the offset is within a predetermined tolerance of a desired value. [Step 5.] This desired value is set according to factors such as manufacture's representation and user's needs. If the offset is found to be within a predetermined tolerance, no adjustment of feed horn attitude with respect to the reflector is necessary.

If the offset is not found to be within a predetermined tolerance, the feed horn attitude (that is, its "orientation") with respect to the reflector must be adjusted to decrease the offset. [Step 6.] After the adjustment, Steps 3–5 may be repeated to verify the decrease in offset and to determine if further adjustment is desirable. If necessary, Steps 3–5 may be repeated multiple times. After obtaining an offset that is found to be within a predetermined tolerance, the alignment procedure may terminate.

Having thus described example embodiments of the invention, it will be apparent that various alterations, modifications, and improvements will readily occur to those skilled in the art. Such alterations, modifications, and improvements, though not expressly described above, are nonetheless intended and implied to be within the spirit and scope of the invention. Accordingly, the foregoing discussion is intended to be illustrative only; the invention is limited and defined only by the following claims and equivalents thereto.

I claim:

1. An alignment tool for an antenna arrangement, said alignment tool comprising;

a light source having a light source axis and configured to direct a beam of light along said light source axis; and a base having a bottom surface, an inner planar surface, and an inner cylindrical surface extending between said bottom surface and said inner planar surface, wherein said base is further configured to position said light source axis with respect to said inner planar surface, wherein said base further comprises:

a first portion, the surface of said first portion including said bottom surface, said inner cylindrical surface, and said inner planar surface;

a second portion, configured to attach to said first portion and to contact said light source; and a third portion configured to secure said light source against said second portion.

2. The alignment tool of claim 1, wherein said base further includes at least one fastener configured to extend through said base toward said inner cylindrical surface.

3. The alignment tool of claim 1, wherein said light source is a laser light source.

4. An alignment tool for an antenna arrangement, said alignment tool comprising;

a light source having a light source axis and configured to direct a beam of light along said light source axis; and a base having a bottom surface, an inner planar surface, and an inner cylindrical surface extending between said bottom surface and said inner planar surface, wherein said base is further configured to position said light source axis with respect to said inner planar surface, and wherein said inner planar surface is a first inner planar surface, said inner cylindrical surface is a first inner cylindrical surface, and said first inner cylindrical surface has a first diameter;

wherein said base further includes a second inner planar surface and a second inner cylindrical surface extending between said first inner planar surface and said second inner planar surface, said second inner cylindrical surface having a second diameter less than said first diameter, and wherein said alignment tool base is further configured to position said light source axis with respect to said second inner planar surface.

5. The alignment tool of claim 4, wherein said base further comprises:

a first portion, the surface of said first portion including said bottom surface, said first inner cylindrical surface, said first inner planar surface, said second inner cylindrical surface, and said second inner planar surface;

a second portion configured to attach to said first portion and to contact said light source; and a third portion configured to secure said light source against said second portion.

6. The alignment tool of claim 4, wherein said base further includes:

a first set of at least one fastener configured to extend through said base toward said first inner cylindrical surface; and a second set of at least one fastener configured to extend through said base toward said second inner cylindrical surface.

7. The alignment tool of claim 6, wherein said base further includes apertures in said first inner planar surface, and said base is further configured to receive at least one fastener from said second set so that the fastener extends from within said aperture toward said second inner cylindrical surface.

8. A method of aligning a feed horn with respect to a reflector of a dish antenna kit, said method comprising:

placing an alignment tool on said feed horn, said alignment tool having a light source;

activating said light source to project a beam of light onto a surface of said reflector;

rotating said alignment tool so that said light beam advances in an arcuate path on said reflector surface;

determining from said arcuate path the offset of the feed horn with respect to a focus point on said reflector surface;

checking whether said offset is within a predetermined tolerance; and if said offset is not within said predetermined tolerance, adjusting the attitude of said feed horn to decrease said offset.

9. The alignment method of claim 8, wherein said determining includes:

detecting the center of said arcuate path; and detecting the distance of said arcuate path center from said focus point; and wherein said adjusting includes decreasing said distance.

10. The alignment method of claim 8, wherein said reflector includes a plurality of constituent panels joined at the edges to form seams;

wherein the focus point of said reflector is the center of said reflector, said seams meeting at said reflector center;

wherein said determining includes:

detecting a plurality of intersections of said arcuate path with a plurality of said seams; and detecting the relative distances of said intersections from said reflector center; and wherein said adjusting includes decreasing said relative distances.

* * * * *